United States Patent [19]

Motoyama et al.

[11] Patent Number: 4,740,771

[45] Date of Patent: Apr. 26, 1988

[54] ARMATURE BIASING MEANS IN AN ELECTROMAGNETIC RELAY

[75] Inventors: Masanori Motoyama, Matsusaka; Atsushi Nakahata, Watarai; Nobuo Kobayashi, Ise; Shigeyuki Okumura, Taki, all of Japan

[73] Assignee: Matsushita Electric Works, Ltd., Japan

[21] Appl. No.: 79,393

[22] Filed: Jul. 30, 1987

[30] Foreign Application Priority Data

Aug. 26, 1986 [JP] Japan ..... 61-130020
Oct. 27, 1986 [JP] Japan ..... 61-164413

[51] Int. Cl.[4] ..... H01F 7/08
[52] U.S. Cl. ..... 335/274
[58] Field of Search ..... 335/78, 80, 229, 230, 335/274, 276

[56] References Cited

U.S. PATENT DOCUMENTS 3,131,268 4/1964 Orner ..... 200/104
4,187,416 2/1980 Caro ..... 200/153 S
4,398,165 8/1983 Iketani ..... 335/128 X
4,684,910 8/1987 Dittmann et al. ..... 335/274

FOREIGN PATENT DOCUMENTS 54140951 11/1979 Japan ..... 335/128
6079633 5/1985 Japan ..... 335/78

*Primary Examiner*—George Harris
*Attorney, Agent, or Firm*—Stevens, Dais, Miller & Mosher

[57] ABSTRACT

An electromagnetic relay includes an electromagnet block and an armature block both mounted together on a relay base. The armature block is magnetically coupled to the electromagnet block such that it is magnetically driven thereby to move linearly between two operating positions for actuating the contact assembly into open and closed contact conditions. The armature block is supported on the base by means of a U-shaped balancing spring with a pair of parallel spring arms in the form of a spring leaf and a web integrally bridging the parallel spring arms at one end of each arm. The balancing spring is secured to the base at the web and carries the armature block with the other end of each spring arm being connected to each of the opposite sides of the armature block at a point an equal distance from said one end of each spring arm such that the parallel spring arms and web are cooperative with said armature block to define a parallelogram, allowing said armature block to swing in a linear path parallel with the length of the web.

11 Claims, 8 Drawing Sheets

ARMATURE BIASING MEANS IN AN ELECTROMAGNETIC RELAY

BACKGROUND OF THE INVENTION

1. Field of the invention

The present invention relates to an electromagnetic relay, and more particularly to an electromagnetic relay having an armature block movable in a linear path between two contact operating positions.

2. Description of the Prior Art

Electromagnetic relays with a linearly movable armature block are known in the art as disclosed, for example, in U.S. Pat. No. 4,538,126 issued on Aug. 27, 1987 to Bando. In this prior art relay, the armature block is held between a pair of separate balancing springs each extending in parallel relation with each other and supported loosely on a relay base. The separate provision of the balancing springs in the prior art relay requires to mount the springs individually on the relay base, making it rather complicate to assembly the balancing springs. Further, the loose connection of each balancing spring to the relay base is very likely to induce fluctuation in the spring force exerted on the armature block, which involves sophisticated technique to obtain a precisely tuned balancing force required for the armature block, in addition to the effect that the separately mounted springs exert the spring forces individually to the armature block. In these respects, the prior art relay is not satisfactory for providing convenient assembly of the balancing spring as well as for providing a consistent balancing effect to the armature block.

SUMMARY OF THE INVENTION

The above problems have been eliminated in the present invention which provides an improved electromagnetic relay. The relay in accordance with the present invention comprises a base for mounting thereon an electromagnet block and contact means and an armature block. The armature block is magnetically coupled to the electromagnet block in such a manner that it is magnetically driven thereby to move linearly between two operating positions for actuating the contact means into open and closed contact conditions. The characterizing feature of the present invention resides in that the armature block is supported on the base by means of a U-shaped balancing spring which has a pair of parallel spring arms in the form of a spring leaf and a web integrally bridging the parallel spring arms at one end of each arm. The balancing spring is secured to the base at its web and carries the armature block with the other end of each spring arm being connected to each of the opposite sides of the armature block at a point an equal distance from the one end of each spring arm such that the parallel spring arms and web are cooperative with the armature block to define a substantial parallelogram, whereby allowing the armature block to swing in a linear path parallel with the length of the web. The utilization of the single balancing spring of U-shaped configuration is advantageous in reducing the number of spring components and facilitating the assembly thereof yet ensuring a stable and accurate balancing effect on the armature block. Further, since the U-shaped spring holding the armature block between the other ends of the spring arms is secured to the relay base at its web, the armature block and the biasing spring combination can be easily assembled at once in the relay structure simply by fixing the web to the relay base.

Accordingly, it is a primary object of the present invention to provide an improved electromagnetic relay which is capable of reducing the number of spring components and facilitating the assembly, yet assuring to give a stable and reliable balancing spring characteristic to the armature movement.

In a preferred form, the U-shaped balancing spring includes an integral bridge segment which bridges between the other ends of the spring arms at points closely adjacent to the juncture of the spring arms with the armature block. With this bridge segment, the balancing spring completes the parallelogram by itself to further improve a consistent balancing spring characteristic responsible for the desired linear movement of the armature block.

It is therefore another object of the present invention to provide an improved electromagnetic relay in which the balancing spring is reinforced by the bridge segment to provide a consistent balancing spring effect on the armature block.

The bridge segment can also serve as another support for the armature block to securely hold the armature block in cooperation with the other end of each spring arm. To this end, the bridge segment is secured to the upper surface of the armature block by a suitable adhesive. Preferably, the bridge segment is in the form of a flat member which is wider at its middle portion than at the juncture ends with the spring arms for giving a greater adhesion area to the armature block, which is therefore a further object of the present invention.

The balancing spring further includes an anchor plate which extends from the web in the direction generally perpendicular to the plane of the spring arms for insertion into a complementary slot formed in the relay base. Either side of the anchor plate is finished as a vertical guide edge extending in perpendicular relation to the length of the web in order that, during the assembly of mounting the armature block on the relay base by inserting the anchor plate into the correspondingly shaped slot, the vertical guide edges act to guide the armature block held by the spring vertically down to the relay base, preventing any lateral displacement of the armature block and movable contact means carried on the lateral sides and extending longitudinally thereof. Thus, the vertical edges of the anchor plate can ensure easy and exact alignment between the movable contact means carried on the armature block and the stationary contact means mounted on the relay base.

It is therefore a still further object of the present invention to provide an improved electromagnetic relay in which the armature block with the movable contact means can be easily assembled to the relay base, while ensuring exact alignment between the movable contact means on the armature block and the stationary contact means on the relay base.

The present invention also discloses a further advantageous feature for adapting the relay in a RF circuit. For this purpose, a RF shield is mounted on the relay base to surround the contact means composed of the movable contact means and the stationary contact means. The RF shield has at least one ground terminal extending outwardly of the base and so arranged to come into electrical contact with the movable contact means in the open contact condition, enabling to electrically isolate one contact member from the adjacent contact member for elimination of RF signal leakage, which is therefore a still further object of the present invention.

These and still other objects and advantages of the present invention will become apparent from the following detailed description of the preferred embodiments of the present invention when taken in conjunction with the accompanying drawings.

DESCRIPTION OF THE PREFERRED EMBODIMENTS

First embodiment <FIGS. 1 to 5>

Figure 1:
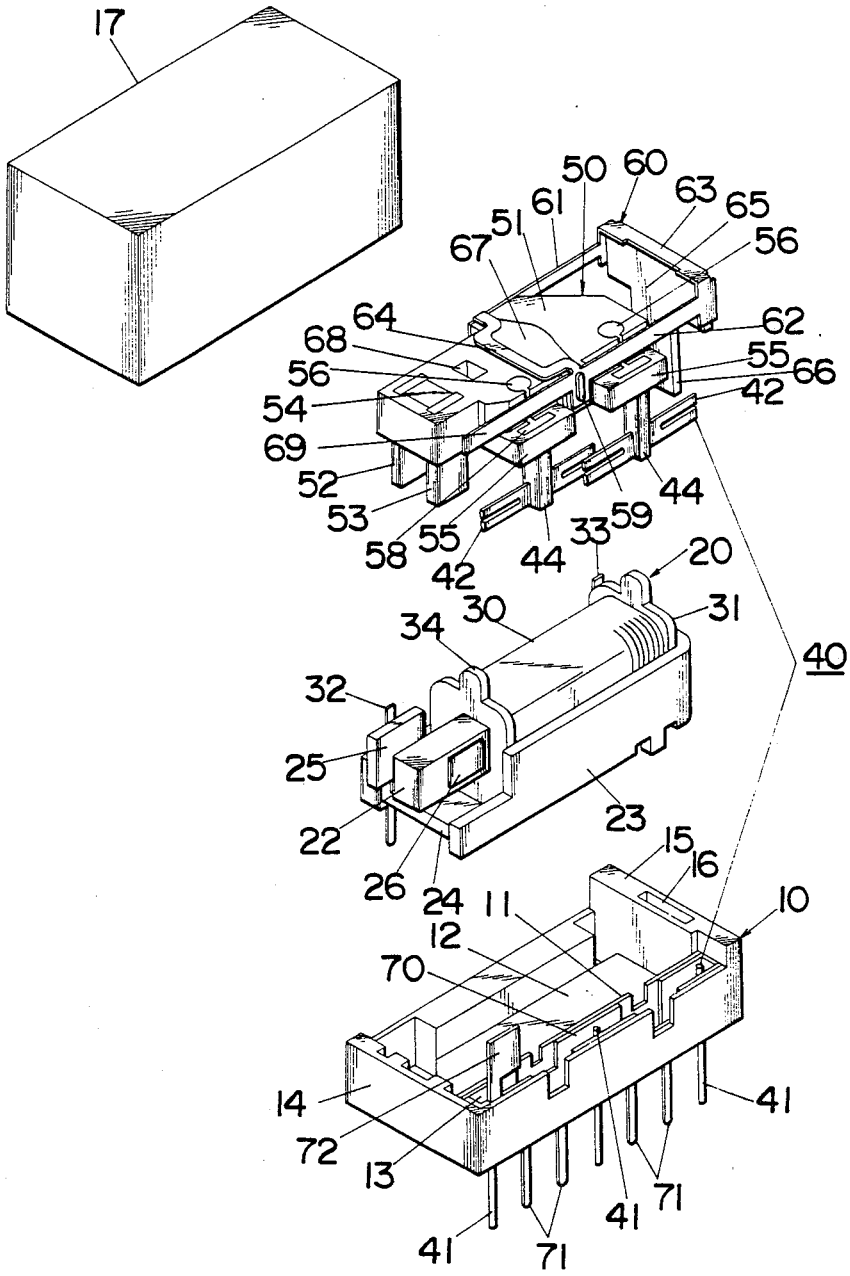
FIG. 1 is an exploded perspective view of an electromagnetic relay in accordance with a first embodiment of the present invention.

Referring now to FIGS. 1 to 4, there is shown an electromagnetic relay in accordance with a first embodiment of the present invention. The relay is of a polarized type which comprises a mount base 10 for mounting thereon an electromagnet block 20, a contact assembly 40, and an armature block 50. The base 10 is molded from an electrically insulative plastic material to have a recess which is divided by a partition wall 11 into chambers 12 and 13, one for receiving the electromagnet block 20 and the other for the contact assembly 40. The partition wall 11 extends full distance between the opposed end walls 14 and 15 and is integrally connected at its ends thereto. A cover 17 of like insulative material fits over the base 10 to encapsulate the entire relay structure.

Figure 4:
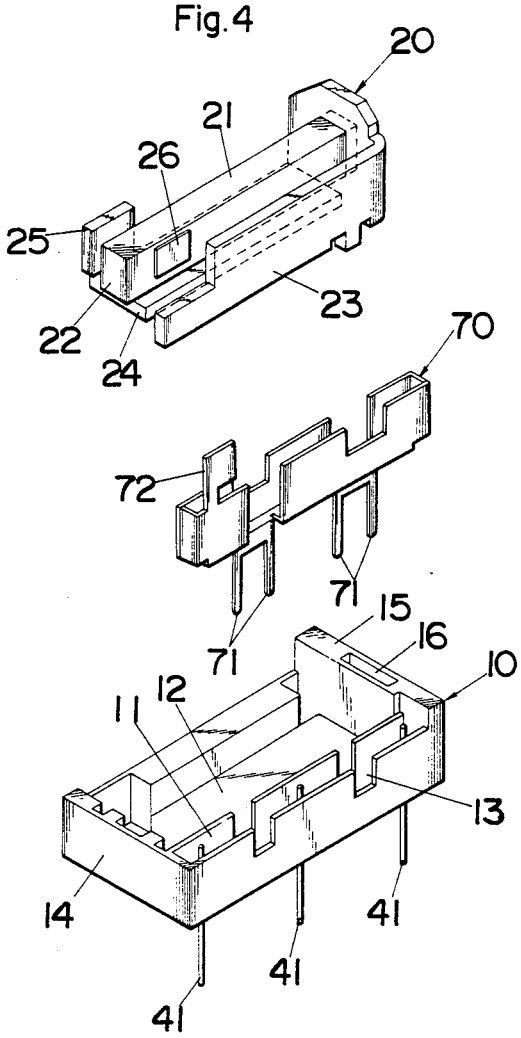
FIG. 4 is an exploded perspective view of an electromagnet block, a RF shield, and a base utilized for the above relay.
Figure 5:
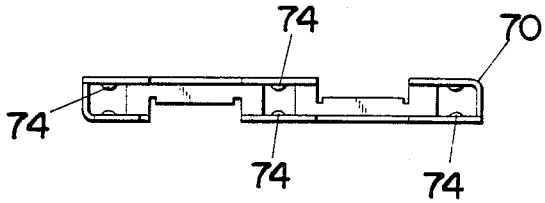
FIG. 5 is a top view of the RF shield.

The electromagnet block 20 comprises a center core 21 and a pair of side and bottom yoke legs 23 and 24 each extending in parallel with the core 21 and coupled at its one end to the adjacent end of the core 21. An excitation coil 30 is placed around the core 21 through a bobbin 31 with the free end of the core 21 left exposed to define thereat a first pole end 22. As best shown in FIG. 4, the side and bottom yoke legs 23 and 24 extend in spaced relation respectively with the one side face and the bottom face of the core 21. The upper half portion of the free end of the side yoke leg 23 is cut out, while the lateral edge of the free end of the bottom yoke leg 23 remote from the side yoke member 23 is upturned to define thereat a second pole end 25 which is coactive with the first pole end 22 of the center core 21 to define a magnetic gap. A residual plate 26 is attached to the side face of the core 21 in confronting relation with the cutout of the side yoke leg 23. The ends of the excitation coil 30 are wired respectively to coil terminals 32 and 33 each supported to the extension of the bobbin 31 to extend outwardly through the bottom of the base 10 when assembled.

Figure 2:
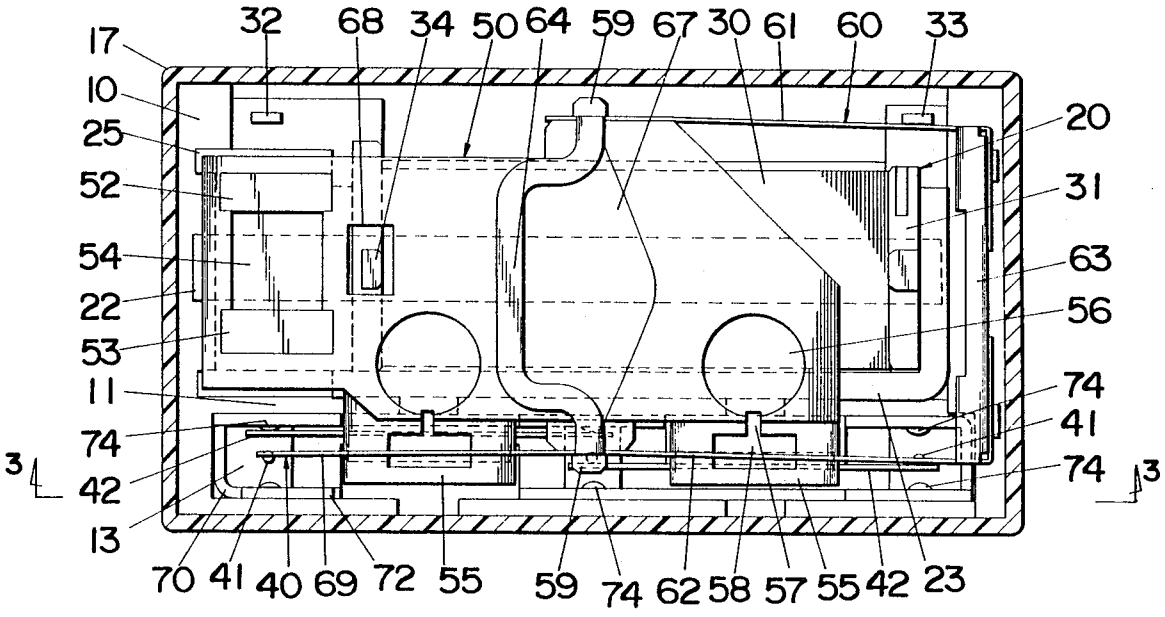
FIG. 2 is a top view partly in section of the above relay.
Figure 3:
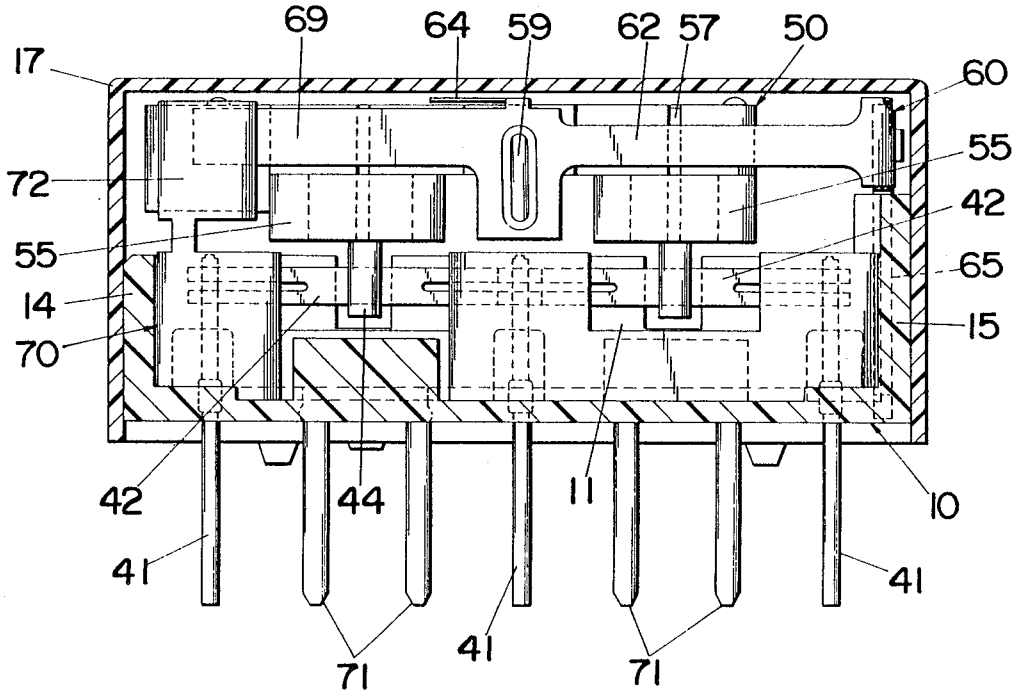
FIG. 3 is a cross sectional view taken along line 3—3 of FIG. 2.

The armature block 50 includes a generally rectangular flat member 51 of electrically insulative plastic material which carries at its longitudinal end a pair of pole plates 52 and 53 and a permanent magnet 54. The pole plates 52 and 53 have their upper end portions embedded in the flat member 51 with the permanent magnet 54 interposed therebetween so as to be magnetized to opposite polarity. The permanent magnet 54 is entirely received within the thickness of the flat member 51, while the lower ends of pole plates 52 and 53 project downwardly from the flat member 51 for magnetic coupling with the pole ends of the electromagnet block 20. Integrally formed on one lateral side of the flat member 51 are a pair of longitudinally spaced ledges 55 each formed with a bottom cavity (not shown) for connection with each of a pair of elongated movable contact springs 42. Each of the movable contact springs 42 is held at its center by a vertical prop 44 of electrical insulative material and is connected to the armature block 50 with the upper end of the prop 44 fitted in the bottom cavity of each ledge 55 so that each contact spring 42 extends horizontally in parallel relation with the longitudinal axis of the armature block 50. As shown in FIGS. 1 and 2, the movable contact springs 42 are longitudinally staggered in such a manner as to overlap the adjacent ends thereof in spaced relation. Formed in the top of the flat member 51 adjacent to each ledge 55 is a circular sink 56 for receiving a suitable adhesive fluid. The adhesive fluid supplied to the sink 56 flows through a trough 57 and a top pit 58 in each ledge 55 into the bottom cavity thereof for enhanced coupling between the flat member 51 and the prop 44 of each movable contact spring 42.

The armature block 50 thus constructed to carry the movable contact springs 42 is supported on the base 10 by means of a U-shaped balancing spring 60 so as to be movable along a linear path perpendicular to the longitudinal axis of the armature block 50 between two contact operating positions. The U-shaped spring 60 has a pair of parallel spring arms 61 and 62 integrally connected at one ends by a web 63. The spring 60 is struck from a metal sheet and bent into the U-shaped configuration in which the parallel spring arms 61 and 62 are allowed to move resiliently within the plane thereof while the web 63 is restrained from moving resiliently within that plane. The spring arms 61 and 62 extend along the lateral sides of the armature block 50 and are fixed at the respective free end portions thereto by means of pins 59 each of which is integral with the flat member 51 and extends through each spring arm 61, 62 to be welded thereover. The pins 59 connect the spring arms 61 and 62 to the flat member 51 at an equal distance from the web 63 such that the parallel spring arms 61 and 62 and the web 63 are cooperative with the flat member 51 to form a parallelogram, allowing the armature block 50 to move linearly in the lateral direction as resiliently flexing the parallel arms 61 and 62. The balancing spring 60 and the armature block 50 held between the spring arms 61 and 62 thereof are together mounted on the base 10 by means of an anchor plate 65 which extends downwardly from the web 63 with its top portion secured to the adjacent ends of the spring arms 61 and 62. The anchor plate 65, which may be alternatively integral with the web 63, projects in vertical relation with respect to the plane of the movement of the armature block 50 and is snugly received in a correspondingly shaped slot 16 formed in the end wall 15 of the base 10. The lateral edges 66 of the anchor plate 65 and the corresponding inner walls of the slot 16 are made vertical with respect to the length of the web 63 or the lateral direction of the armature block 50 so that, during the insertion of the anchor plate 64 into the slot 16, the armature block 50 can be guided straight down to the base 10 without lateral movement or fluctuation, contributing to exact and easy positioning of the movable contact springs into a predetermined relation to stationary contact pins 41 on the base 10. A bridge segment 64 integrally bridges between the spring arms 61 and 62 at points corresponding to the pins 59 so as to reinforce the parallelogram as well as to serve as an additional element for coupling with the armature block 50. To this end, like adhesive fluid is utilized for adhering the bridge segment 64 to the top of the flat member 51, the adhesive being supplied to and received in a shallow recess 67 in the top of the flat member 51. Thus, the weight of the armature block 50 is mainly supported by the bridge segment 64 while it is drivingly supported by a pair of the parallel spring arms 61 and 62. The above bridge segment 64 is particularly advantageous in that it can retain the parallelogram even when either or both of the spring arms 61 and 62 might suffer from deformation at the connections with the pins 59.

The stationary contact pins 41 are composed of three longitudinally aligned pins which extend vertically through the bottom of the chamber 13 of the base 10 in an equally spaced relation to each other, as best shown in FIG. 2, and which are cooperative with the movable contact springs 42 to define the contact assembly 40. One of the movable contact spring 42 is disposed on one side of one pair of the adjacent two stationary contact pins 41 in an engageable relation therewith at its longitudinal ends, while the other movable contact spring 42 is on the opposite side of the other pair of the adjacent two stationary contact pins 41 in an engageable relation therewith at its longitudinal ends. The movable contact springs 42 are so arranged that one movable contact spring 42 is in closed contact condition with the corresponding stationary contact pins 41 when the other spring 42 in open contact condition.

As shown in FIG. 2, the armature block 50 mounted on the base 10 by the balancing spring 60 is magnetically coupled to the electromagnet block 20 located therebelow in such a way that the first pole end 22 of the core 21 extends between the pole plates 52 and 53 and at the same time that the pole plate 52 extends between the first pole end 22 and the second pole end 25. Thus, upon deenergization of the excitation coil 30 the armature block 50 is held stable in a first contact operative position where the pole plates 53 and 52 are attracted respectively to the first and second pole ends 22 and 25 to complete the magnetic flux of the permanent magnet. 54. In this position, one of the movable contact springs 42 is actuated into closed condition and the other spring 42 into open condition. When the excitation coil 30 is energized to a particular polarity, the armature block 50 responds to move linearly into a second contact operative position for reversing the contacts where the pole plate 52 is attracted to the first pole end 22 of the core 21 just magnetized to the opposite polarity. In this way the armature block 50 is driven to move linearly between the two contact operating positions as resiliently flexing the spring arms 61 and 62 of the balancing spring 60. During this linear movement of the armature block 50, an element 34 projecting integrally from the coil bobbin 31 and slidably received in an opening 68 serves as an aid for smoothly guiding the armature block 50 in its linear path.

The contact assembly 40 composed of the stationary contact pins 41 and the movable contact spring 42 is surrounded by a RF (radio-frequency) shield 70 with a plurality of spaced ground pins 71. The RF shield 70 is shaped from an electrical conductive sheet into a rectangular shape and received in the chamber 13 in intimate contact with the inner walls thereof and with the ground pins 71 extending outwardly through the bottom wall of the base 10. Projected on the inner surface of the RF shield 70 at positions corresponding to the stationary contact pins 41 are respective nubs 74 on which the adjacent movable contact springs 42 rest to be grounded when they come into open condition, ensuring to electrically isolate the one movable contact spring 42 in open condition from the other movable contact spring 42 and the associated circuit. Integrally formed with the RF shield 70 is an adjusting stud 72 which extends upwardly past the electromagnet block 20 to be enagageable with an integral extension 69 of the spring arm 61. As necessary, the adjusting stud 72 is twisted or bent to positively engage the extension 69 for biasing the balancing spring 60 in one direction in order to obtain a desired balancing effect upon the armature block 50.

Figure 6:
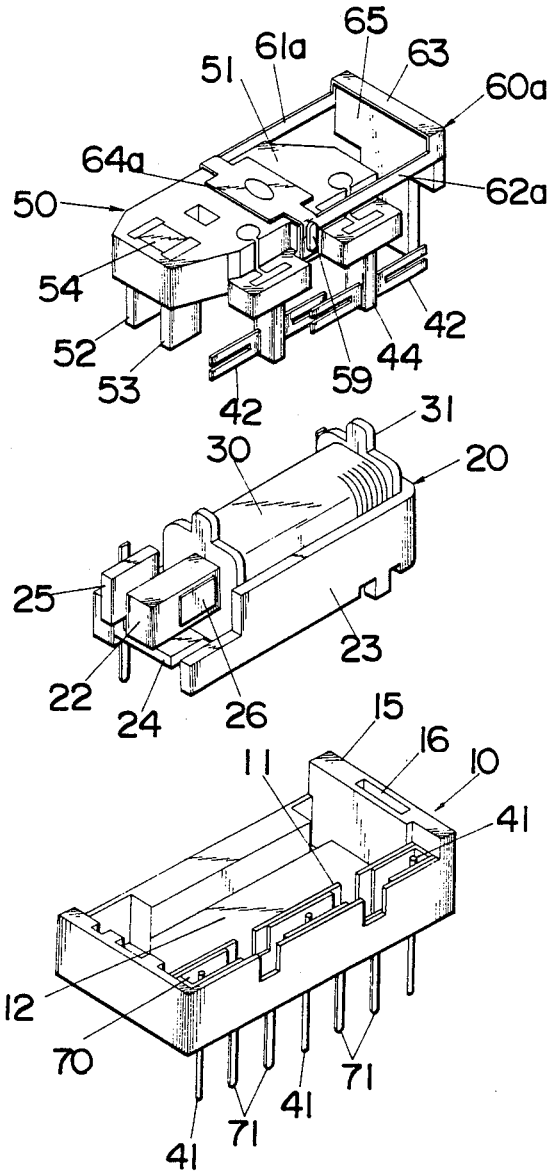
FIG. 6 is an exploded perspective view of a first modification of the relay of FIG. 1.

FIG. 6 shows a first modification of the above embodiment which is identical in construction and operation to the first embodiment except that an improved bridge segment **64*a* is utilized to bridge the free ends of spring arms 61*a* and 62*a* of a balancing spring 60*a*, and except that the adjusting stud 72 and the associated parts are eliminated. For an easy reference purpose, like numerals are employed to designate like parts. The bridge segment 64*a* of the modification is shaped to have a flat middle of a greater width than at the juncture ends with the spring arms 61*a* and 62*a*. The increased width of the bridge segment 64*a* assures an increased bonding surface area with the top of the armature block 50** for enhanced bonding therebetween by the adhesive.

Figure 7:
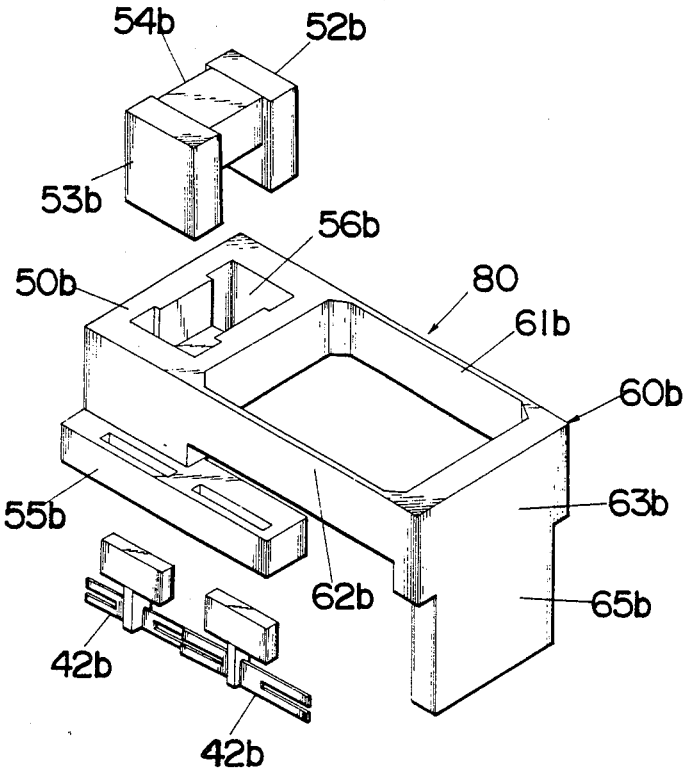
FIG. 7 is an exploded perspective view illustrating an integral combination of an armature block and a balancing spring in accordance with a second modification of the relay of FIG. 1.

FIG. 7 shows a second modification of the first embodiment in which a balancing spring **60*b* and an armature block 50*b* are integrally combined to provide a combination block 80 of onepiece construction. The other structures of the relay are identical to the first embodiment and therefore further duplicated explanation is elimiated. The combination block 80 is molded from an electrically insulative material in which the armature block 50*b* and an anchor plate 65*b* are thick-formed to be of rigid construction. The armature block 50*b* and the anchor 65*b* are connected by a pair of integral members 61*b* and 62*b* which are thin-formed to define parallel spring arms of the balancing spring 60*b*. The spring arms 61*b* and 62*b* are interconnected by the upper end of the anchor plate 65*b*, which defines the web 63*b* of U-shaped configuration, and are cooperative with the integral armature block 50*b* to define a parallelogram, whereby allowing the armature block 50*b* to move linearly in the lateral direction as resiliently flexing the spring arms 61*b* and 62*b* in the same manner as in the first embodiment. The armature block 50*b* is formed with an opening 56*b* for receiving together a pair of pole plates 52*b* and 53*b*** and a permanent magnet 54*b* and is formed further with a ledge 55*b* for receiving a set of movable contact springs 42*b*.

Figure 8:
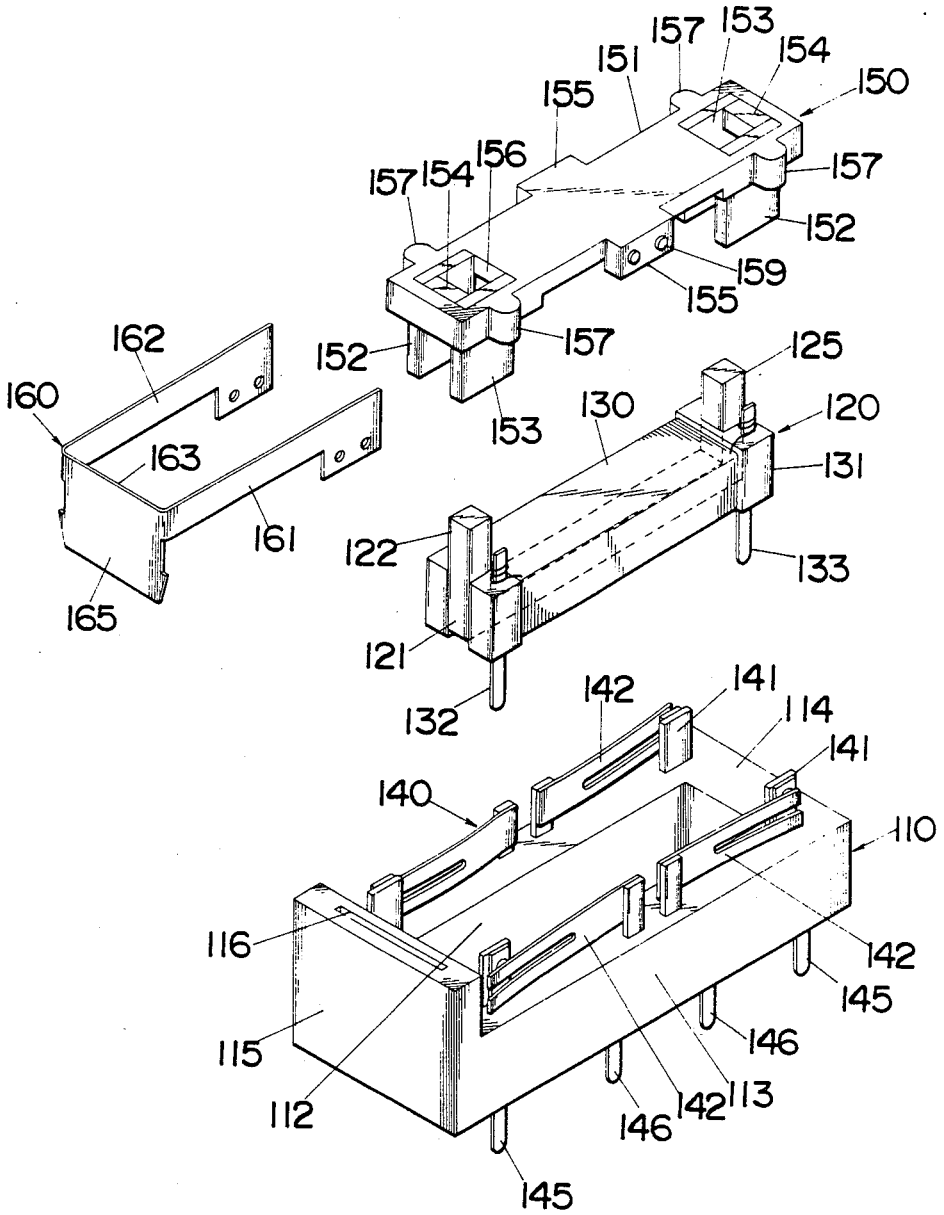
FIG. 8 is an exploded perspective view of an electromagnetic relay in accordance with a second preferred embodiment of the present invention.
Figure 9:
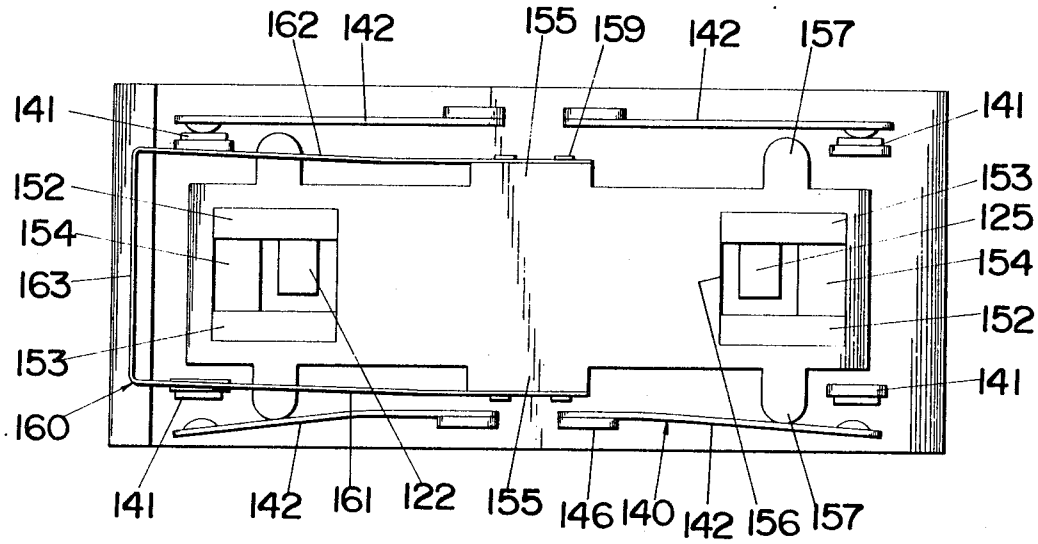
FIG. 9 is a top view of the relay of FIG. 8.

Second embodiment <FIGS. 8 and 9>

Referring to FIGS. 8 and 9, a polarized electromagnetic relay in accordance with a second embodiment of the present invention is shown to comprise a base 110, an electromagnet block 120, a contact assembly 140, and an armature block 150. The electromagnet block 120 is received in an elongated chamber 112 in the base 110 which is surrounded by side walls 113 and end walls 114 and 115. Mounted on each side wall 113 is a set of longitudinally spaced contact assemblies 140 each composed of a stationary contact 141 and a movable contact spring 142. These contacts 141 and 142 have respective terminal lugs 145 and 146 extending downwardly through the side wall 113. One end wall 115 of greater height than the opposed wall 114 is formed in its top with a slot 116 for mounting together the combination of the armature block and a balancing spring 160.

The electromagnet block 120 includes a generally U-shaped core 121 with opposed pole ends 122 and 125 at its both ends. An excitation coil 130 carried on a bobbin 131 is placed around the center portion of the core 121 with the opposed pole ends 122 and 125 projecting upwardly from the ends of the bobbin 131. The coil ends of the excitation coil 130 are connected to respective coil terminals 132 and 133 extending downwardly through the bobbin 131 and through the bottom of the chamber 112 when assembled.

The armature block 150 comprises a generally rectangular flat member 151 of electrically insulative material carrying at each longitudinal end a permanent magnet 154 interposed between a pair of pole plates 152 and 153. The upper ends of the pole plates 152 and 153 are fitted together with the permanent magnet 154 within each of vertical holes 156 in the longitudinal ends of the flat member 151 so as to project the lower ends of the pole plates 152 and 153 which are polarized to opposite polarity by the permanent magnet 154. Between the pole plates 152 and 153 at each end of the armature block 150 is projected each of the opposed pole ends 122 and 125 for magnetically coupling the armature block 150 and the electromagnet 120. Formed on the longitudinal center of each lateral side of the flat member 151 is an integral ledge 155 with pins 159. Also formed on either longitudinal ends of each lateral side of the flat member 151 are integral cards 157 for driving the corresponding movable contact springs 142 upon linear movement of the armature block 150.

The balancing spring 160 which mounts the armature block 150 on the relay base 110 is shaped from a metal sheet into a U-shaped configuration with a pair of parallel spring arms 161 and 162 integrally connected at one ends with a web 163. An anchor plate 165 integrally extends downwardly from the web 163 for insertion into the slot 116 of the base 110. The armature block 150 is held between the spring arms 161 and 162 by inserting the pins 159 through the free end of each spring arm and deforming them into fixed engagement with each spring. The connected ends of the spring arms 161 and 162 are at equal distance from the web 164 and the lateral distance between the connected ends of the spring arms 161 and 162 is substantially equal to the length of the web 164, such that the balancing spring 160 is cooperative with the armature block 150, or the segment between the connected ends of the spring arms to define a parallelogram which allows the armature block 150 to move linearly in the lateral direction. It is to be noted at this point that the combination of the armature block 150 and the balancing spring 160 can be easily assembled as a single unit on the relay base 110 simply by inserting the anchor plate 165 of the balancing spring 160 into the slot 116 of the base 110, as in the like manner in the previous embodiments and modifications.

In operation, when the excitation coil 130 is energized by a given polarity of voltage, the armature block 150 is driven to linearly move to first contact operating position as shown, for example, in FIG. 9 where the one pole plate 152 (153) of each set is attracted to the adjacent pole end 122 (125) while the other pole plate 153 (152) is repelled therefrom, pushing the movable springs 142 on one side of the armature block 150 at the cards 157 to open the contacts while leaving the movable springs 142 on the other side of the armature block 150 to flex resiliently for contact closing. The armature block 150 is kept stable in this position unless the excitation coil 130 is energized by the opposite polarity of voltage. Upon this energization, the armature block 150 is driven to move linearly into the other contact operating position with the other pole plate 153 (152) of each set being attracted to the adjacent pole end 122 (125), reversing the contacts by the like action of the cards 157.

What is claimed is:

1. In an electromagnetic relay comprising:

a base for mounting thereon an electromagnet block and contact means;

an armature block mounted on the base and magnetically coupled to the electromagnet block such that it is magnetically driven thereby to move linearly between two operating positions for actuating the contact means into open and closed contact conditions;

the improvement being characterized in that said armature block is supported on the base by means of a U-shaped balancing spring with a pair of parallel spring arms in the form of a spring leaf and a web integrally bridging the parallel spring arms at one end of each arm, said balancing spring being secured to said base at the web and carrying the armature block with the other end of each spring arm being connected to each of the opposite sides of the armature block at a point an equal distance from said one end of each spring arm such that the parallel spring arms and the web are cooperative with said armature block to define a parallelogram, allowing said armature block to swing in a linear path parallel with the length of the web.

2. An electromagnetic relay as set forth in claim 1, wherein said other ends of the parallel spring arms being integrally connected by a bridge segment at a point corresponding to the juncture end of each spring arm to the armature block.

3. An electromagnetic relay as set forth in claim 2, wherein said bridge segment is adhered on the armature block.

4. In an electromagnetic relay comprising:

a base for mounting thereon an electromagnet block;

an armature block mounted on the base and carrying movable contact spring means engageable with stationary contact means mounted on the base, said armature block being magnetically coupled to the electromagnet block such that it is magnetically driven thereby to move linearly between two operating positions for bringing said movable contact means into open and closed contact conditions with said stationary contact means;

the improvement being characterized in that:

said armature block is supported on the base by means of a U-shaped balancing spring with a pair of parallel spring arms in the form of a spring leaf and a web integrally bridging the parallel spring arms at one end of each arm, said balancing spring being secured to said base at the web and carrying the armature block with the other end of each spring arm being connected to each of the opposite sides of the armature block at a point spaced an equal distance from said one end of each spring arm such that the parallel spring arms and web are cooperative with said armature block to define a parallelogram, allowing said armature block to swing in a linear path parallel. with the length of the web, said movable contact spring means comprising at least one movable contact spring carried on the armature block to extend in parallel relation with said spring arms, said balancing spring further including an anchor plate which extends from said web at an angle with respect to the plane of the parallel spring arms for insertion into a complementary slot formed in said base, said anchor plate being formed along its lateral edges respectively with vertical guide edges which extend in perpendicular relation to the length of said web and in parallel relation with the movable contact spring and which come into mating engagement respectively with correspondingly shaped vertical side walls on the opposite sides of said slot, such that the movable contact spring can be positioned into a suitable relation with said stationary contact means without causing lateral displacement therebetween when the armature block is assembled on the base with the anchor plate inserted into said slot.

5. An electromagnetic relay as set forth in claim 4, wherein said other ends of the parallel spring arms being integrally connected by a bridge segment at a point corresponding to the juncture of each spring arm to the armature block.

6. An electromagnetic relay as set forth in claim 4, wherein said bridge segment is in the form of a flat member which is wider at its middle portion than at its juncture ends with the spring arms, said wider flat middle portion being bonded to the armature block by an adhesive.

7. An electromagnetic relay as set forth in claim 6, wherein said bridge segment is adhered on the armature block.

8. An electromagnetic relay as set forth in claim 4, wherein one of said parallel spring arms of the balancing spring has an extension which extends past its juncture with the armature block to have its free end portion into abuttable engagement with an adjusting stud projecting on said base, said adjusting stud being manually deformable to adjust the spring force which the balancing spring exerts on the armature block in its linear movement between said two operating positions.

9. An electromagnetic relay as set forth in claim 4, further including:

a RF shield which is fitted in a compartment formed in said base in order to surround said stationary contact means and the movable contact means, said shield having at least one ground terminal extending outwardly of the base and being so arranged to come into electrical contact with the movable contact spring means when the movable contact spring means is actuated by the armature block into open contact condition with said stationary contact means.

10. An electromagnetic relay as set forth in claim 9, wherein said compartment is separated from the electromagnet block by a partition wall integrally formed with said base, said electromagnet block including a yoke member which extends along substantially the entire length of said partition wall in close contact therewith for reinforcing the partition wall.

11. An electromagnetic relay as set forth in claim 4, wherein said stationary contact means comprises three fixed contact pins aligned on a straight line and said movable contact spring means comprises a pair of elongated movable contact springs which are spaced in parallel relation with each other to be located on the opposite sides of said line and which are staggered longitudinally with one longitudinal end of one movable contact spring placed over the adjacent end of the other movable contact spring, each of the movable contact spring being disposed with its longitudinal ends in engageable relation with the adjacent two of said fixed contact pins for contact closing and opening such that one movable contact spring is in closed contact condition with the corresponding pair of the fixed contact pins when the other movable contact spring is in open contact condition with the other adjacent two of the fixed contact pins.

* * * * *